US011480063B1

(12) United States Patent
Miller et al.

(10) Patent No.: US 11,480,063 B1
(45) Date of Patent: Oct. 25, 2022

(54) GAS TURBINE ENGINE WITH INLET PRE-SWIRL FEATURES

(71) Applicant: General Electric Company, Schenectady, NY (US)

(72) Inventors: Brandon Wayne Miller, Liberty Township, OH (US); Tsuguji Nakano, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/485,706

(22) Filed: Sep. 27, 2021

(51) Int. Cl.
*F01D 9/04* (2006.01)
*F01D 17/14* (2006.01)

(52) U.S. Cl.
CPC ..... *F01D 9/041* (2013.01); *F01D 17/14* (2013.01); *F05D 2220/32* (2013.01); *F05D 2240/12* (2013.01)

(58) Field of Classification Search
CPC ..... F01D 9/041; F01D 17/14; F05D 2220/32; F05D 2240/12
See application file for complete search history.

(56) References Cited

U.S. PATENT DOCUMENTS 3,540,682 A 11/1970 Dibble et al.
5,010,729 A 4/1991 Adamson et al.
5,762,470 A * 6/1998 Gelmedov ..... F04D 29/4213 415/173.1
7,055,304 B2 6/2006 Courtot et al.
7,246,773 B2 7/2007 Stoner et al.
7,374,404 B2 5/2008 Schilling
7,789,620 B2 9/2010 Vontell, Sr. et al.
8,529,188 B2 9/2013 Winter
8,689,538 B2 4/2014 Sankrithi et al.
8,943,796 B2 2/2015 McCaffrey
9,045,991 B2 6/2015 Read et al.
9,540,094 B2 1/2017 Negulescu et al.
9,695,751 B2 7/2017 Kupratis et al.
9,874,109 B2 1/2018 Hatcher, Jr. et al.
9,945,247 B2 4/2018 Appukuttan et al.
10,046,424 B2 * 8/2018 Reynolds ..... F04D 29/164
10,113,444 B2 10/2018 Huang et al.
10,145,301 B2 12/2018 Abrari et al.
(Continued)

FOREIGN PATENT DOCUMENTS

CN 101922312 12/2010
EP 3163028 A1 * 5/2017 ..... F01D 5/146
(Continued)

*Primary Examiner* — Igor Kershteyn
*Assistant Examiner* — Brian Christopher Delrue
(74) *Attorney, Agent, or Firm* — Dority & Manning, P.A.

(57) ABSTRACT

A gas turbine engine may include a fan, a plurality of inlet pre-swirl features disposed upstream of a fan, and an outlet guide vane assembly disposed downstream of the fan. The outlet guide vane assembly includes a plurality of outlet guide vanes that may define an outlet guide vane solidity profile, wherein the outlet guide vane solidity profile is achieves a minimum solidity at a radial position between an inner boundary and seventy percent of an outlet guide vane span. The fan includes a plurality of fan blades that may define a fan solidity profile, wherein the fan solidity profile maintains a solidity of greater than 1.1 between a radial position at seventy percent of the fan blade span and an outer boundary.

20 Claims, 11 Drawing Sheets

(56) References Cited

U.S. PATENT DOCUMENTS

| | | | | |
|---|---|---|---|---|
| 10,184,340 | B2 | 1/2019 | Baltas et al. | |
| 10,240,526 | B2 | 3/2019 | Suciu et al. | |
| 10,288,010 | B2 | 5/2019 | Houston et al. | |
| 10,288,083 | B2 | 5/2019 | Miller et al. | |
| 10,344,711 | B2 | 7/2019 | Hsu | |
| 10,378,554 | B2 | 8/2019 | Yu et al. | |
| 10,399,664 | B2 | 9/2019 | Bowden et al. | |
| 10,557,415 | B2 | 2/2020 | Boudebiza et al. | |
| 10,563,513 | B2 | 2/2020 | Kalitzin et al. | |
| 10,690,146 | B2 | 6/2020 | Urac et al. | |
| 10,697,471 | B2 * | 6/2020 | Northall | F04D 29/544 |
| 10,711,797 | B2 * | 7/2020 | Kroger | F04D 29/684 |
| 10,724,435 | B2 * | 7/2020 | Kroger | F04D 29/563 |
| 10,794,292 | B2 | 10/2020 | Kupratis et al. | |
| 10,794,395 | B2 | 10/2020 | Tamada | |
| 10,794,396 | B2 * | 10/2020 | Kroger | F02C 7/04 |
| 10,801,442 | B2 | 10/2020 | Clements et al. | |
| 10,815,886 | B2 * | 10/2020 | Kroger | F04D 29/541 |
| 10,822,999 | B2 | 11/2020 | Morris et al. | |
| 10,823,114 | B2 | 11/2020 | Clements et al. | |
| 10,837,361 | B2 | 11/2020 | Abrari et al. | |
| 2001/0023582 | A1 | 9/2001 | Nagel | |
| 2009/0277181 | A1 | 11/2009 | Druon et al. | |
| 2013/0192263 | A1 | 8/2013 | Suciu et al. | |
| 2016/0017751 | A1 | 1/2016 | Caruel | |
| 2016/0084265 | A1 * | 3/2016 | Yu | F02C 7/045 415/177 |
| 2016/0195010 | A1 | 7/2016 | Roberge | |
| 2017/0138202 | A1 * | 5/2017 | Wadia | F01D 5/141 |
| 2018/0073377 | A1 * | 3/2018 | Hall | F02K 3/06 |
| 2018/0363554 | A1 * | 12/2018 | Kroger | F02C 3/04 |
| 2018/0363676 | A1 * | 12/2018 | Kroger | F04D 29/542 |
| 2019/0107119 | A1 | 4/2019 | Yu et al. | |
| 2019/0226402 | A1 | 7/2019 | Kray et al. | |
| 2020/0049077 | A1 | 2/2020 | Schwarz et al. | |
| 2020/0149421 | A1 | 5/2020 | Lad | |
| 2021/0078715 | A1 | 3/2021 | Bevirt et al. | |
| 2021/0108597 | A1 | 4/2021 | Ostdiek et al. | |

FOREIGN PATENT DOCUMENTS

| | | | | |
|---|---|---|---|---|
| GB | 2403778 | A | 1/2005 | |
| JP | 2006177341 | A * | 7/2006 | F01D 5/141 |

* cited by examiner

GAS TURBINE ENGINE WITH INLET PRE-SWIRL FEATURES

FIELD

The present disclosure generally relates to a gas turbine engine configured for use with one or more inlet pre-swirl features.

BACKGROUND

A gas turbine engine generally includes a fan and a turbomachine arranged in flow communication with one another. The turbomachine of the gas turbine engine generally includes, in serial flow order, a compressor section, a combustion section, a turbine section, and an exhaust section. In operation, air is provided from the fan to an inlet of the compressor section where one or more axial compressors progressively compress the air until it reaches the combustion section. Fuel is mixed with the compressed air using one or more fuel nozzles within the combustion section and burned to provide combustion gases. The combustion gases are routed from the combustion section to the turbine section. The flow of combustion gasses through the turbine section drives the turbine section and is then routed through the exhaust section, e.g., to atmosphere.

Typical gas turbine engines include a drive turbine within the turbine section that is configured to drive, e.g., a low pressure compressor of the compressor section and the fan. Although drive turbines can operate more efficiently at relatively high speeds, the inventors of the present disclosure have found that high speed operation of the driven fan can be problematic due to inefficiencies such as flow separation and shock losses at the fan or further downstream. Speed reduction mechanisms have been used to reduce fan speeds, but can add complication, weight, and expense. Accordingly, the inventors of the present disclosure have found that there is a need for a gas turbine engine designed to operate efficiently at high fan speeds.

BRIEF DESCRIPTION OF THE DRAWINGS

The accompanying drawings, which are incorporated in and constitute a part of this specification, illustrate embodiments of the present disclosure and, together with the description, serve to explain principles of the disclosure.

Other aspects and advantages of the embodiments disclosed herein will become apparent upon consideration of the following detailed description, wherein similar or identical structures may have similar or identical reference numerals.

DETAILED DESCRIPTION

Figure 1:
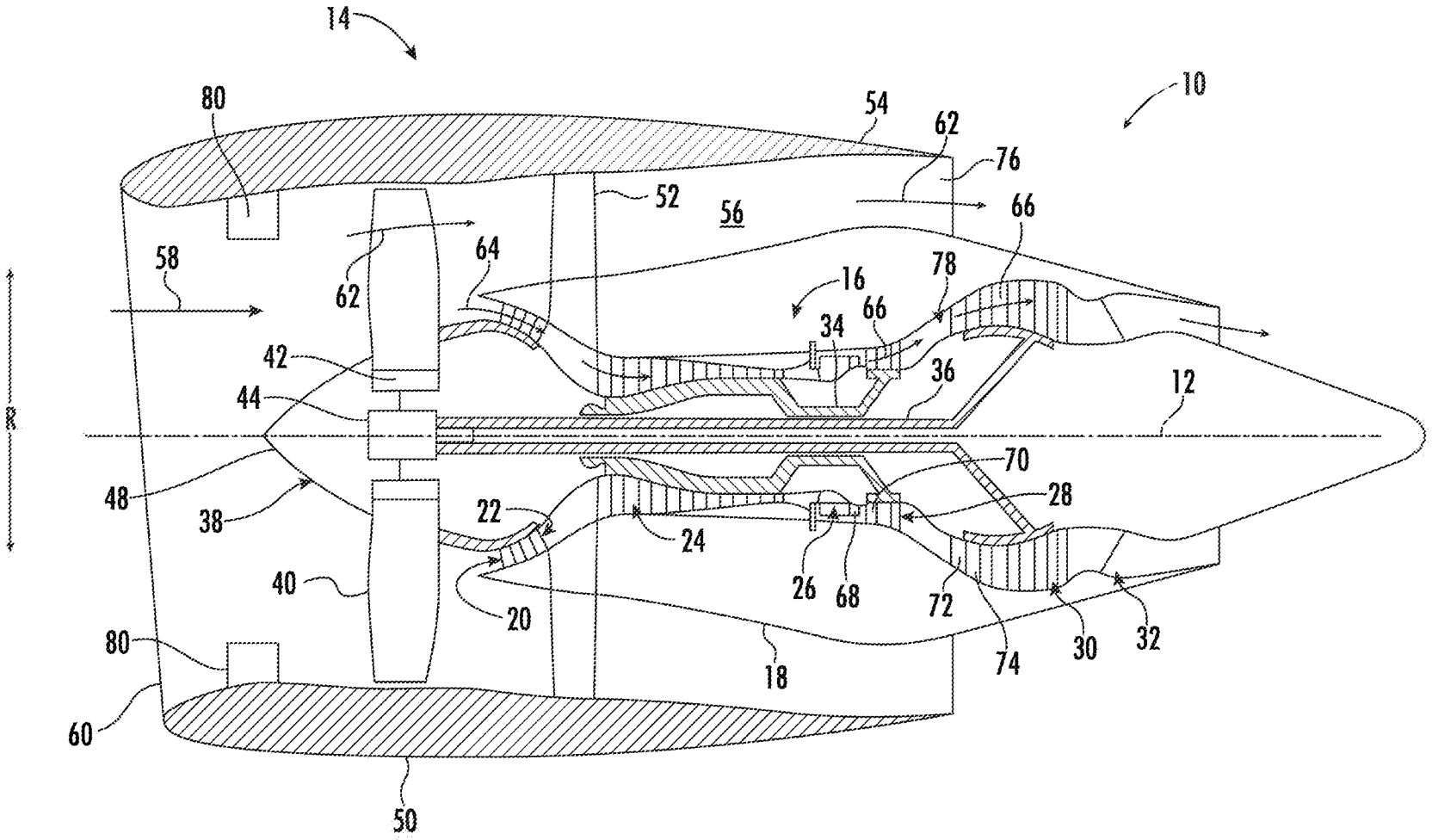
FIG. 1 is a schematic sectional view of an exemplary gas turbine engine according to various embodiments of the present subject matter.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components.

The terms "forward" and "aft" refer to relative positions within a gas turbine engine, with forward referring to a position closer to an engine inlet and aft referring to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, in certain contexts, the approximating language may refer to being within a 10% margin.

Here and throughout the specification and claims, range limitations may be combined and interchanged, such that ranges identified include all the sub-ranges contained therein unless context or language indicates otherwise. For example, all ranges disclosed herein are inclusive of the endpoints, and the endpoints are independently combinable with each other.

The term "turbomachine" or "turbomachinery" refers to a machine including one or more compressors, a heat generating section (e.g., a combustion section), and one or more turbines that together generate a torque output.

The term "gas turbine engine" refers to an engine having a turbomachine as all or a portion of its power source. Example gas turbine engines include turbofan engines, turboprop engines, turbojet engines, turboshaft engines, etc., as well as hybrid-electric versions of one or more of these engines.

The term "combustion section" refers to any heat addition system for a turbomachine. For example, the term combustion section may refer to a section including one or more of a deflagrative combustion assembly, a rotating detonation combustion assembly, a pulse detonation combustion assembly, or other appropriate heat addition assembly. In certain example embodiments, the combustion section may include an annular combustor, a can combustor, a cannular combustor, a trapped vortex combustor (TVC), or other appropriate combustion system, or combinations thereof.

As air speeds in a gas turbine engine increase, flow separation can occur on aerodynamic surfaces within the engine. Flow separation can be managed with pre-swirl features to decrease speed differentials between airflow and aerodynamic surfaces within the engine. However, it has been found that existing aerodynamic surfaces do not optimally manage airflow downstream of pre-swirl features. It is an object of the present disclosure to provide a technical solution for optimally managing airflow downstream of pre-swirl features in a gas turbine engine.

To optimally manage airflow downstream of pre-swirl features in a gas turbine engine, a technical solution provided for herein is to configure an outlet guide vane solidity profile to achieves a minimum solidity at a radial position between an inner boundary and seventy percent (70%) of an outlet guide vane span. A further technical solution is to configure a fan solidity profile that maintains a solidity of greater than 1.2 at a radial position between seventy percent (70%) of a fan blade span and an outer boundary.

Referring now to the drawings, wherein identical numerals indicate the same elements throughout the figures, FIG. 1 is a schematic cross-sectional view of a gas turbine engine in accordance with an exemplary embodiment of the present disclosure. More particularly, for the embodiment of FIG. 1, the gas turbine engine is a high-bypass turbofan jet engine 10, referred to herein as "turbofan engine 10." As shown in FIG. 1, the turbofan engine 10 defines an axial direction A (extending parallel to a longitudinal centerline 12 provided for reference), a radial direction R, and a circumferential direction C (i.e., a direction extending about the axial direction A). In general, the turbofan engine 10 includes a fan section 14 and a turbomachine 16 disposed downstream from the fan section 14.

The exemplary turbomachine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22. The LP turbine 30 may also be referred to as a "drive turbine".

For the embodiment depicted, the fan section 14 includes a fan 38 having a plurality of fan blades 40 coupled to a disk 42 in a spaced apart manner. As in the embodiment of FIG. 1, the fan 38 may be configured for variable pitch adjustment of the plurality of fan blades 40. As depicted, the fan blades 40 extend outwardly from disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan 38 is mechanically coupled to and rotatable with the LP turbine 30, or drive turbine. More specifically, the fan blades 40, disk 42, and actuation member 44 are together rotatable about the longitudinal centerline 12 by LP shaft 36 in a "direct drive" configuration. Accordingly, the fan 38 is coupled with the LP turbine 30 in a manner such that the fan 38 is rotatable by the LP turbine 30 at the same rotational speed as the LP turbine 30. Although the depicted embodiment provides that the fan 38 has an axis of rotation about the longitudinal centerline 12, it is contemplated that the axis of rotation of the fan may also be distinct from the longitudinal centerline 12, as in an off-axis fan arrangement.

As described above, the fan 38 depicted in FIG. 1 is part of a high-bypass turbofan engine 10. For example, a mass flow rate of air bypassing the turbomachine 16 can significantly exceed a mass flow rate of air entering the turbomachine 16. A bypass ratio, as defined below with reference to the first and second portions of air indicated by arrows 62 and 64, respectively, can be in a range between 2:1 and 20:1. In certain embodiments, the bypass ratio may exceed 3:1, 5:1, 8:1, or 10:1. To achieve these bypass ratios, a relatively large fan 38 may be required. In certain embodiments, the fan 38 may be in a range of sixty to one hundred thirty inches in diameter. For example, the fan 38 may be at least seventy inches in diameter, for example embodiments of the fan 38 could be eighty, ninety, or one hundred inches in diameter. As diameter of the fan 38 increases, so does maximum linear speed for a given rotational speed. With increased linear speed, maintaining flow attachment at the fan 38 and efficient flow properties downstream presents a technical problem. It is a technical objective herein to provide configuration of a high-bypass turbofan engine that is efficiently operable at relatively high rotational and linear speeds.

It should be appreciated, however, that the exemplary turbofan engine 10 depicted in FIG. 1 is by way of example only, and that in other exemplary embodiments, the turbofan engine 10 may have any other suitable configuration. For example, in other exemplary embodiments, the fan 38 may be configured as fixed pitch fan. Furthermore, the turbofan engine 10 may be configured as a geared turbofan engine having a reduction gearbox between the LP shaft 36 and fan section 14.

Further, it will be appreciated that the fan 38 defines a fan pressure ratio and the plurality of fan blades 40 each define a fan tip speed. As will be described in greater detail below, the exemplary turbofan engine 10 depicted defines a relatively high fan tip speed and relatively low fan pressure ratio during operation of the turbofan engine at a rated speed. As used herein, the "fan pressure ratio" refers to ratio of a pressure immediately downstream of the plurality of fan blades 40 during operation of the fan 38 to a pressure immediately upstream of the plurality of fan blades 40 during the operation of the fan 38. Also as used herein, the "fan tip speed" defined by the plurality of fan blades 40 refers to a linear speed of an outer tip of a fan blade 40 along the radial direction R during operation of the fan 38. Further, still, as used herein, the term "rated speed" refers to a maximum operating speed of the turbofan engine 10, in which the turbofan engine 10 generates a maximum amount of power.

Referring still to the exemplary embodiment of FIG. 1, the disk 42 is covered by a rotatable front hub 48 aerodynamically contoured to promote an airflow through the plurality of fan blades 40. Additionally, the exemplary fan section 14 includes an annular fan casing or outer nacelle 50 that circumferentially surrounds the plurality of fan blades 40 of the fan 38 and/or at least a portion of the turbomachine 16. More specifically, a downstream section 54 of the nacelle 50 extends over an outer portion of the turbomachine 16 so as to define a bypass airflow passage therebetween. Additionally, for the embodiment depicted, the nacelle 50 is supported relative to the turbomachine 16 by a plurality of circumferentially spaced outlet guide vanes 52. The plurality of outlet guide vanes 52 may directly interface with each of the turbomachine 16 and the nacelle 50, or one or more intermediate components may function together to provide relative support therebetween.

During operation of the turbofan engine 10, a volume of air 58 enters the turbofan engine 10 through an associated inlet 60 of the nacelle 50 and/or fan section 14. As the volume of air 58 passes across the fan blades 40, a first portion of the air 58 as indicated by arrows 62 is directed or routed into a bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with fuel and burned to provide combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and a plurality of HP turbine rotor blades 70 that are coupled to the HP shaft or spool 34, thus causing the HP shaft or spool 34 to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and a plurality of LP turbine rotor blades 74 that are coupled to the LP shaft or spool 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the turbomachine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan engine 10, also providing propulsive thrust. The HP turbine 28, the LP turbine 30, and the jet exhaust nozzle section 32 at least partially define a hot gas path 78 for routing the combustion gases 66 through the turbomachine 16.

It should be appreciated, however, that the exemplary turbofan engine 10 depicted in FIG. 1 and described above is by way of example only, and that in other exemplary embodiments, the turbofan engine 10 may have any other suitable configuration. For example, in other exemplary embodiments, the turbomachine 16 may include any other suitable number of compressors, turbines, and/or shaft or spools. Additionally, the turbofan engine 10 may not include each of the features described herein, or alternatively, may include one or more features not described herein. For example, in other exemplary embodiments, the fan 38 may not be a variable pitch fan. Additionally, although described as a "turbofan" gas turbine engine, in other embodiments the gas turbine engine may instead be configured as any other suitable ducted gas turbine engine.

Referring still to FIG. 1, and as previously discussed, the exemplary turbofan engine 10 depicted in FIG. 1 is configured as a direct drive turbofan engine 10, however other configurations are also contemplated. For example, a geared configuration of the turbofan engine 10 could be implemented, where a reduction gear ratio can be selected to maintain high rotational speed operation of the fan 38. However, still referring to the direct drive turbofan engine 10, the interplay of the fan 38 and power generation components in the turbomachine 16 with relative speeds fixed relative to one another must be considered. In order to increase an efficiency of the turbomachine 16, the LP turbine 30 is configured to rotate a relatively high rotational speed. Given the direct-drive configuration, this relatively high speed rotation of the turbomachine 16 also causes the plurality of fan blades 40 of the fan 38 to rotate at a relatively high rotational speed. For example, during operation of the turbofan engine 10 at the rated speed, the fan tip speed of each of the plurality of fan blades 40 is greater than 1,250 feet per second. In certain exemplary embodiments, during operation of the turbofan engine 10 at the rated speed, the fan tip speed of each of the plurality of fan blades 40 may be greater than about 1,350 feet per second, such as greater than about 1,450 feet per second, such as greater than about 1,550 feet per second, such as up to about 2,200 feet per second.

Despite these relatively high fan tip speeds, the fan 38 is, nevertheless designed to define a relatively low fan pressure ratio. For example, during operation of the turbofan engine 10 at the rated speed, the fan pressure ratio of the fan 38 is greater than 1.0 and less than 1.5. For example, during operation of the turbofan engine 10 at the rated speed, the fan pressure ratio may be between about 1.15 and about 1.5, such as between about 1.25 and about 1.4. Additionally, the fan 38 may be configured to maintain a relatively consistent fan pressure ratio across a range of its span as described below with reference to FIG. 14.

As will be appreciated, operating a high speed turbofan engine 10 in such a manner may ordinarily lead to efficiency penalties of the fan 38 due to shock losses and flow separation, especially at the outer tips of the plurality of fan blades 40 of the fan 38 along the radial direction R. Accordingly, as will be described in greater detail below, the turbofan engine 10 may further include one or more inlet pre-swirl features 80 upstream of the plurality of fan blades 40 of the fan 38 to offset or minimize such efficiency penalties of the fan 38. With the inclusion of such inlet pre-swirl features, the efficiency gains of the turbomachine 16 due to, e.g., increased rotational speeds of the LP turbine 30, can outweigh the above identified potential efficiency penalties.

Figure 2:
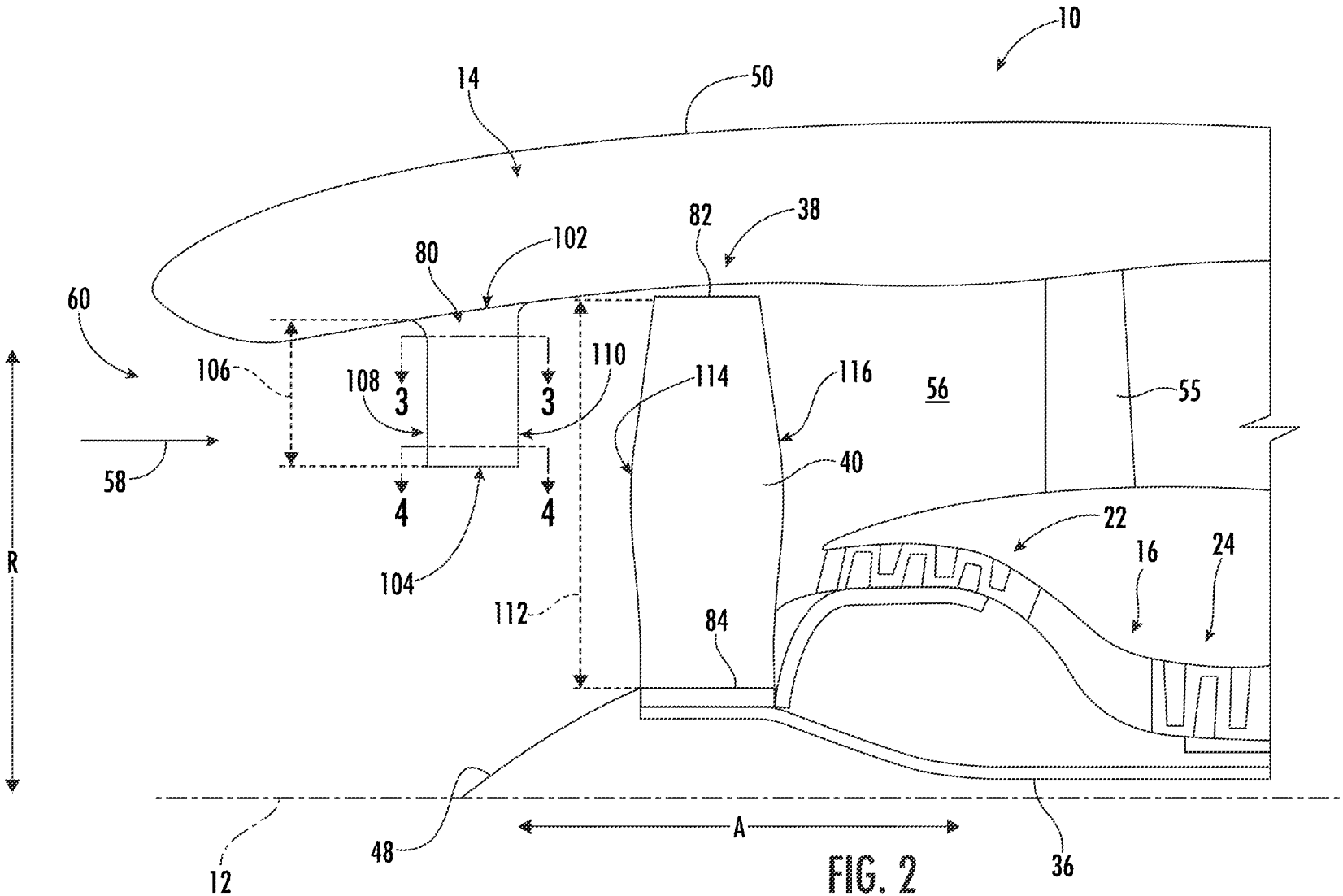
FIG. 2 is a close-up schematic sectional view of a forward end of the exemplary gas turbine engine of FIG. 1.

Referring now also to FIG. 2, a close-up, cross-sectional view of the fan section 14 and forward end of the turbomachine 16 of the exemplary turbofan engine 10 of FIG. 1 is provided. As stated, the turbofan engine 10 includes an inlet pre-swirl feature 80 located upstream of the plurality of fan blades 40 of the fan 38 and attached to or integrated into the nacelle 50. More specifically, for the embodiment of FIGS. 1 and 2, the inlet pre-swirl feature 80 is configured as a plurality of part span inlet guide vanes. Each of the plurality of inlet pre-swirl features 80 of part span inlet guide vane configuration may be cantilevered from the nacelle 50 at a location forward of the plurality of fan blades 40 of the fan 38 along the axial direction A. In this configuration, each of the plurality of inlet pre-swirl features 80 defines an outer end 102 along the radial direction R, and are attached or connected to the nacelle 50 at the outer end 102. For example, each of the inlet pre-swirl features 80 may be bolted to the nacelle 50 at the outer end 102, welded to the nacelle 50 of the outer end 102, or attached to the nacelle 50 in any other suitable manner at the outer end 102.

Further, for the embodiment depicted, the each of the plurality of inlet pre-swirl features 80 extends generally along the radial direction R from its respective outer end 102 to a respective inner end 104 generally along the radial direction R. Moreover, as will be appreciated, for the embodiment depicted, each of the plurality of inlet pre-swirl features 80 is unconnected with an adjacent one of the plurality of inlet pre-swirl features 80 at its respective inner end 104. More specifically, for the embodiment depicted, each inlet pre-swirl feature 80 is completely supported by its connection to or integration with the nacelle 50 at the respective outer end 102 (and not through any structure extending, e.g., between adjacent inlet pre-swirl features at a location inward of the outer end along the radial direction R).

As depicted in FIG. 2, each of the plurality of inlet pre-swirl features 80 does not extend completely between the nacelle 50 and, e.g., the hub 48. More specifically, for the embodiment depicted, each of the plurality of inlet pre-swirl features 80 defines a pre-swirl feature span 106 along the radial direction R. More specifically, each of the plurality of inlet pre-swirl features 80 further define a leading edge 108 and a trailing edge 110, where the pre-swirl feature span 106 refers to a measure along the radial direction R between the outer end 102 and the inner end 104 of the pre-swirl feature 80 at the leading edge 108 of the pre-swirl feature 80. Similarly, it will be appreciated that the each of the plurality of fan blades 40 of the fan 38 defines a fan blade span 112 along the radial direction R. More specifically, each of the plurality of fan blades 40 of the fan 38 defines a leading edge 114 and a trailing edge 116, where the fan blade span 112 refers to a measure along the radial direction R between a radially outer tip 82 and a base 84 of the fan blade 40 at the leading edge 114 of the respective fan blade 40.

For the embodiment depicted, the pre-swirl feature span 106 is at least about five percent of the fan blade span 112 and up to about fifty five percent of the fan blade span 112. For example, in certain exemplary embodiments, the pre-swirl feature span 106 may be between about fifteen percent of the fan blade span 112 and about forty five percent of the fan blade span 112, for example between about thirty percent of the fan blade span 112 and about forty percent of the fan blade span 112.

Although not depicted, in certain exemplary embodiments, the number of the plurality of inlet pre-swirl features 80 may be substantially equal to the number of fan blades 40 of the fan 38 of the turbofan engine 10. In other embodiments, however, the number of the plurality of inlet pre-swirl features 80 may be greater than the number of fan blades 40 of the fan 38 of the turbofan engine 10, or alternatively, may be less than the number of fan blades 40 of the fan 38 of the turbofan engine 10.

Further, it should be appreciated, that in other exemplary embodiments, the turbofan engine 10 may include any other suitable number of inlet pre-swirl features 80 and/or circumferential spacing of inlet pre-swirl features 80. For example, the turbofan engine 10 may include fewer than twenty and at least eight inlet pre-swirl features 80. In an embodiment, the turbofan engine 10 specifically includes exactly eight inlet pre-swirl features 80. Additionally, it should be understood that the plurality of inlet pre-swirl features 80 may be evenly or unevenly spaced along the circumferential direction C.

Still referring to the embodiment of FIG. 2, it will be appreciated that each of the plurality of inlet pre-swirl features 80 is configured to pre-swirl airflow 58 provided through the inlet 60 of the nacelle 50, upstream of the plurality of fan blades 40 of the fan 38. As described above, pre-swirling the airflow 58 provided through the inlet 60 of the nacelle 50 prior such airflow 58 reaching the plurality of fan blades 40 of the fan 38 may reduce separation losses and/or shock losses, allowing the fan 38 to operate with the relatively high fan tip speeds described above with minimal losses in efficiency.

Figure 3:
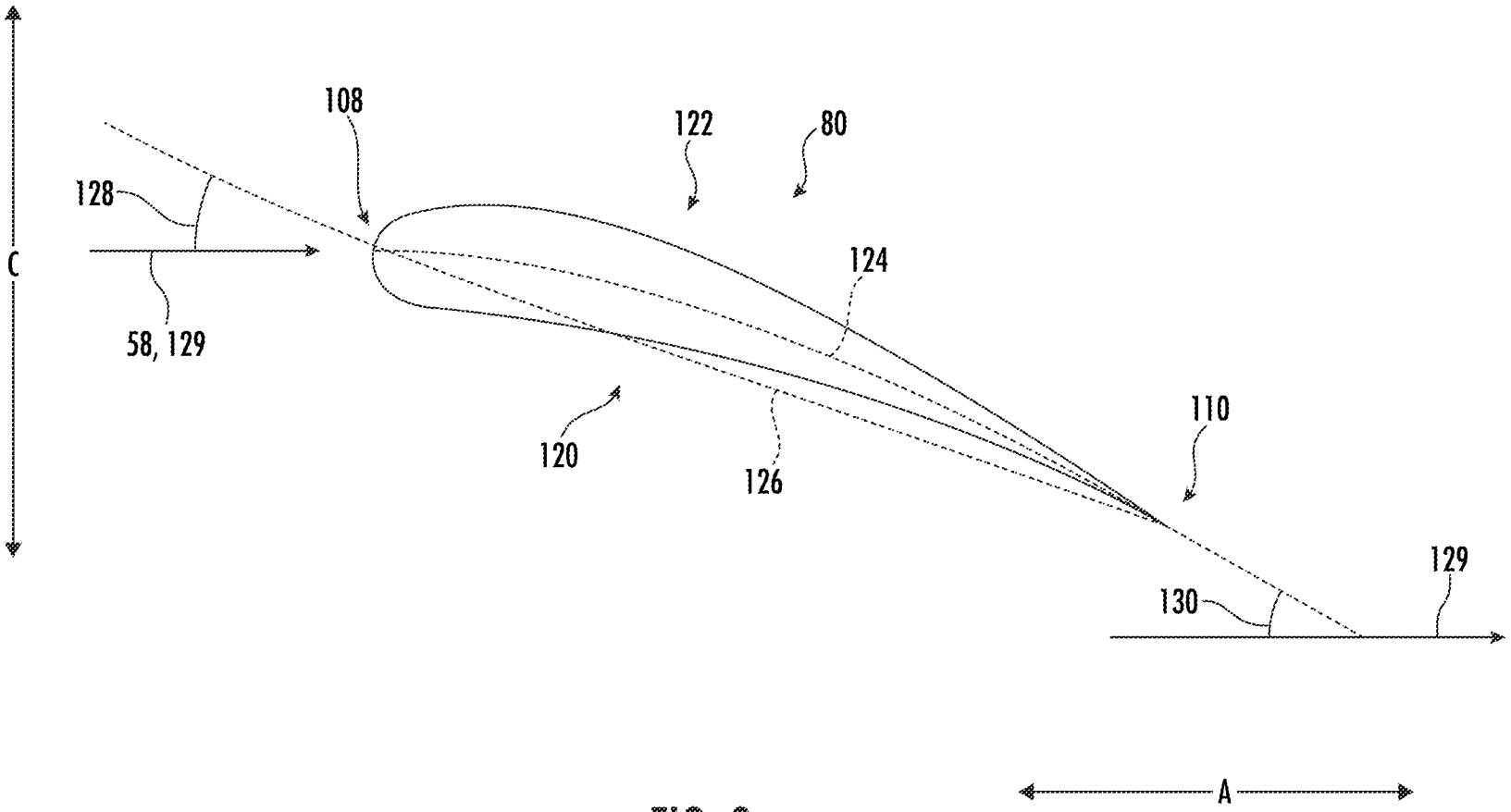
FIG. 3 is a sectional view of an inlet pre-swirl feature taken along line 3-3 in FIG. 2.

For example, referring first to FIG. 3, a cross-sectional view of one inlet pre-swirl feature 80 along the span 106 of the inlet pre-swirl feature 80, as indicated by Line 3-3 in FIG. 2, is provided. As depicted, the inlet pre-swirl feature 80 is configured generally as an airfoil having a pressure side 120 and suction side 122 opposite the pressure side 120. This airfoil extends between the leading edge 108 and the trailing edge 110 of the inlet pre-swirl feature 80 along a camber line 124. Additionally, the inlet pre-swirl feature 80 defines a chord line 126 extending directly from its leading edge 108 to its trailing edge 110. The chord line 126 defines an angle of attack 128 with the airflow direction 129 of the airflow 58 through the inlet 60 of the nacelle 50. For the embodiment depicted, the angle of attack 128 at the location depicted along the span 106 (See FIG. 2) of the inlet pre-swirl feature 80 is at least about five degrees and up to about thirty five degrees. In certain embodiments, the angle of attack 128 at the location depicted along the span 106 of the inlet pre-swirl feature 80 may be between about ten degrees and about thirty degrees, such as between about fifteen degrees and about twenty-five degrees.

Additionally, the inlet pre-swirl feature 80, at the location depicted in FIG. 3 along the span 106 of the inlet pre-swirl feature 80 defines a local swirl angle 130 at the trailing edge 110. The local swirl angle 130 at the trailing edge of the inlet pre-swirl feature 80, as used herein, refers to an angle between the airflow direction 129 of the airflow 58 through the inlet 60 of the nacelle 50 and a reference line defined by a trailing edge 110 of the pressure side 120 of the inlet pre-swirl feature 80. More specifically, the reference line is defined by the aft twenty percent of the pressure side 120, as measured along the chord line 126 of the inlet pre-swirl feature 80.

Figure 4:
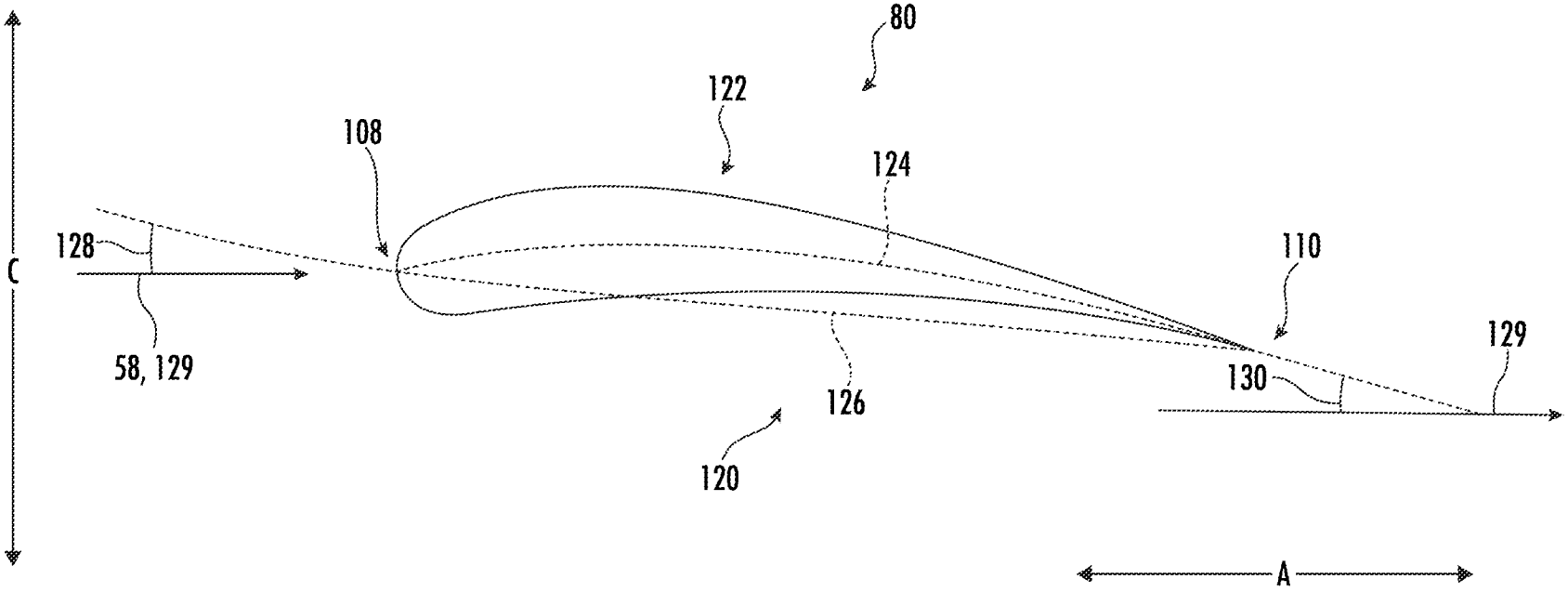
FIG. 4 is a sectional view of the inlet pre-swirl feature of FIG. 3 taken along line 4-4 in FIG. 2.

As described herein, the local swirl angle 130 is variable along the span 106 of a given inlet pre-swirl feature 80. Accordingly, a swirl angle profile can be defined to describe the swirl angle achieved at different radial positions or percentages of the span 106 of the plurality of inlet pre-swirl features. As further described below, FIG. 3 is representative of a maximum swirl angle where FIG. 4 is representative of a minimum swirl angle.

Further, it will be appreciated, that a maximum swirl angle refers to the highest value of the local swirl angle 130 along the span 106 of the inlet pre-swirl feature 80 and that a minimum swirl angle refers to the lowest value of the local swirl angle 130 along the span 106 of the inlet pre-swirl feature 80. For the embodiment depicted, the maximum swirl angle is defined at the radially outer end 102 of the inlet pre-swirl feature 80, as is represented by the cross-section depicted in FIG. 3. Furthermore, the minimum swirl angle is defined at the radially inner end 104 (See FIG. 2) of the inlet pre-swirl feature 80, as is represented by the cross-section depicted in FIG. 4 (described presently). For the embodiment depicted, the maximum swirl angle of each of the plurality of inlet pre-swirl features 80 at the trailing edge is between five degrees and thirty five degrees. For example, in certain exemplary embodiments, the maximum swirl angle of an inlet pre-swirl feature 80 at the trailing edge 110 may be between 12 degrees and 25 degrees.

Moreover, it should be appreciated that for the embodiment of FIG. 2, the local swirl angle increases from the radially inner end 104 to the radially outer end 102 of each inlet pre-swirl feature 80. For example, referring now also to FIG. 4, a cross-sectional view of an inlet pre-swirl feature 80 at a location radially inward from the cross-section viewed in FIG. 3, as indicated by Line 4-4 in FIG. 2, is provided. As is depicted in FIG. 4, the angle of attack 128 defined by the chord line 126 and the airflow direction 129 of the airflow 58 through the inlet 60 of the nacelle 50 is less than the angle of attack 128 at the cross-section depicted in FIG. 3 (e.g., may be at least about twenty percent less, such as at least about fifty percent less, such as up to about one hundred percent less). Additionally, the inlet pre-swirl feature 80 defines a further local swirl angle 130 at the trailing edge 110 at the location along the span 106 (See FIG. 2) of the inlet pre-swirl feature 80 proximate the inner end 104 (See FIG. 2), as depicted in FIG. 4. As described above, the local swirl angle 130 may increase from the radially inner end 104 to the radially outer end 102 (See FIG. 2) of each of the plurality of inlet pre-swirl features 80. Accordingly, the swirl angle 130 proximate the outer end 102 (see FIG. 3) is greater than the swirl angle 130 proximate the radially inner end 104 (see FIG. 4). For example, the swirl angle 130 may approach zero degrees (e.g., may be less than about five degrees, such as less than about two degrees) at the radially inner end 104.

As described above, pre-swirling the airflow 58 may allow the fan 38 to operate with the relatively high fan tip speeds described above with minimal losses in efficiency. However, this pre-swirling of the airflow 58 causes a cascade of downstream effects on downstream components of the gas turbine engine such as the fan 38 and the outlet guide vanes 52. As further described below, the fan 38 and the outlet guide vanes 52 can be configured to increase overall efficiency by more effectively handling airflow 58 that has been pre-swirled.

Figure 5:
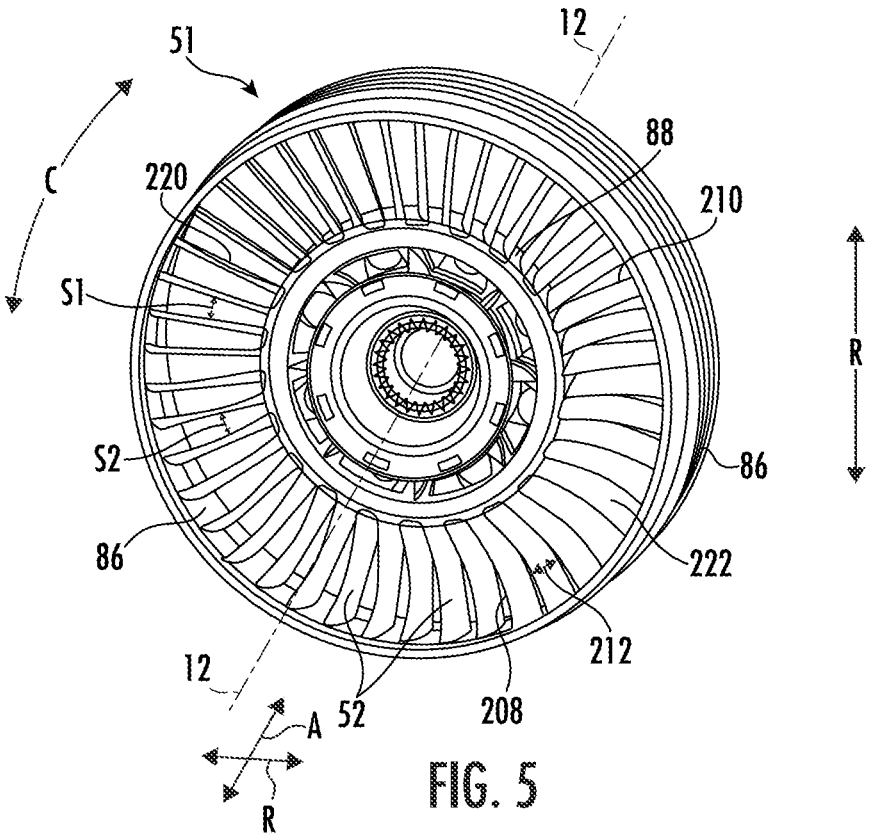
FIG. 5 is a partial perspective view of an outlet guide vane assembly.

Turning now to FIG. 5, an exemplary partial view of an outlet guide vane assembly 51 is shown having a plurality of outlet guide vanes 52. As described below, the outlet guide vanes 52 can be configured to manage airflow 58 that has been pre-swirled by the inlet pre-swirl features 80 (and swirled by the fan 38) disposed upstream in the axial direction A. It has been found that a turbofan engine 10 including pre-swirl features 80 as described above can be further improved in its configuration of outlet guide vanes 52. For example, at least in part by controlling or accounting for a velocity vector of the airflow 58 in the circumferential direction C, the outlet guide vanes 52 can more efficiently guide the airflow 58 from the fan 38.

As shown in the embodiment of FIG. 5, the outlet guide vane assembly 51 includes an outer shroud 86 and an inner shroud 88, between which the plurality of outlet guide vanes 52 are disposed. While the outer shroud 86 and the inner shroud 88 may be used to define a span 206 of the outlet guide vanes 52, it should be understood that various other components of the turbofan engine 10 may serve as the outer and inner shrouds 86, 88. For example, the outlet guide vanes 52 may be configured to interface directly with the nacelle 50, with the nacelle 50 effectively taking the place of the outer shroud 86. Alternatively, the outer shroud 86 may be configured to mount to the nacelle 50.

As with other aerodynamic surfaces described herein, individual outlet guide vanes 52 of the plurality of outlet guide vanes 52 define the span 206 (see FIG. 6), a leading edge 208, a trailing edge 210, a chord 212 between the leading edge 208 and the trailing edge 210, a pressure side 220, a suction side 222, and a thickness (not labeled) between the pressure side 220 and the suction side 222. The chord 212, thickness, and other characteristics of the outlet guide vanes 52 may be variable along the span 206 of a given one of the outlet guide vanes 52. For example, a given outlet guide vane 52 may have a generally increasing or decreasing chord 212 along its span 206.

Figure 6:
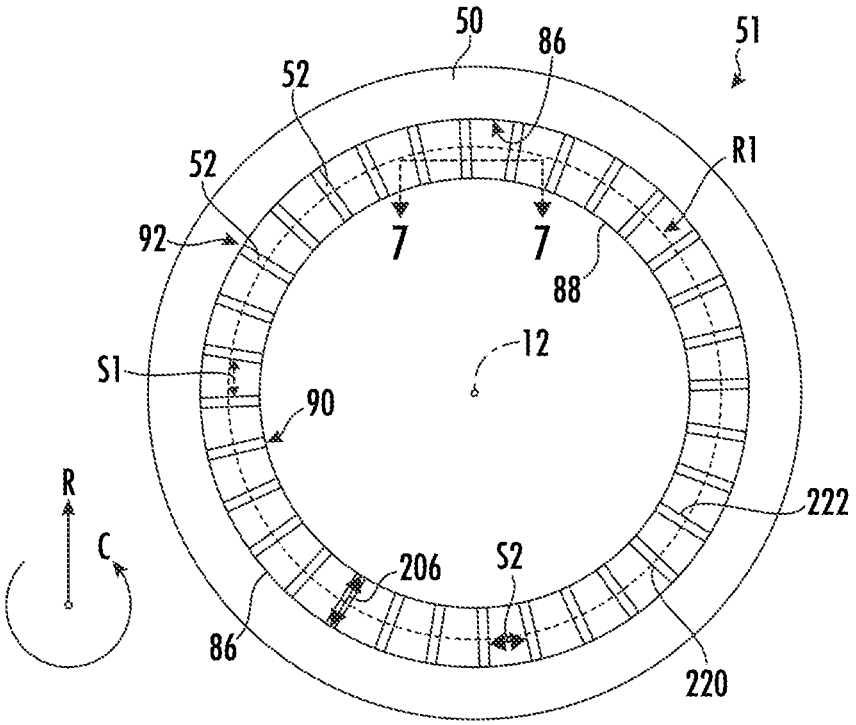
FIG. 6 is a schematic sectional view of an outlet guide vane assembly.
Figure 8:
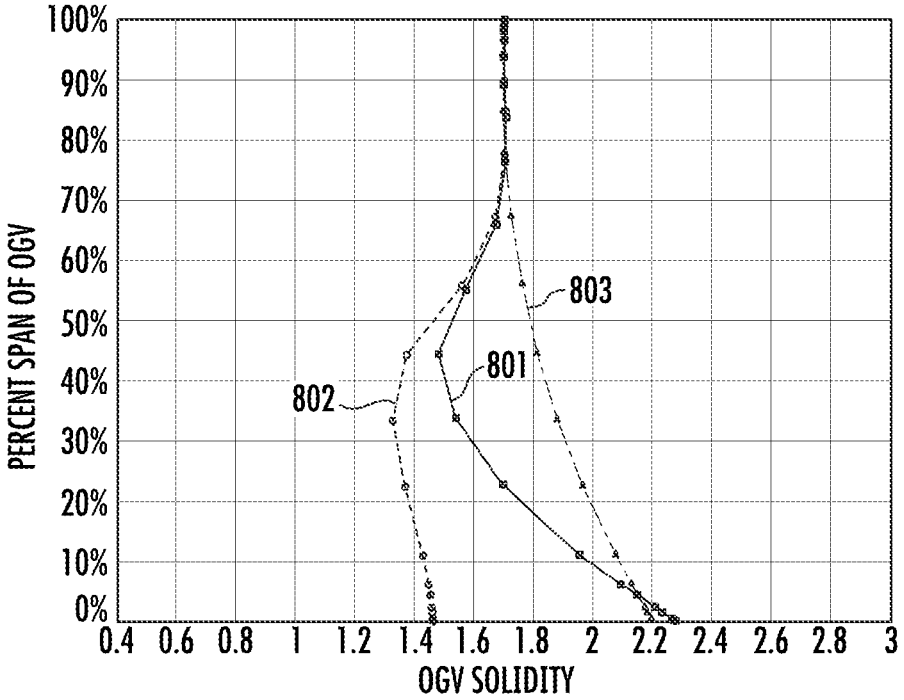
FIG. 8 is a chart depicting outlet guide vane solidity as a function of span.
Figure 9:
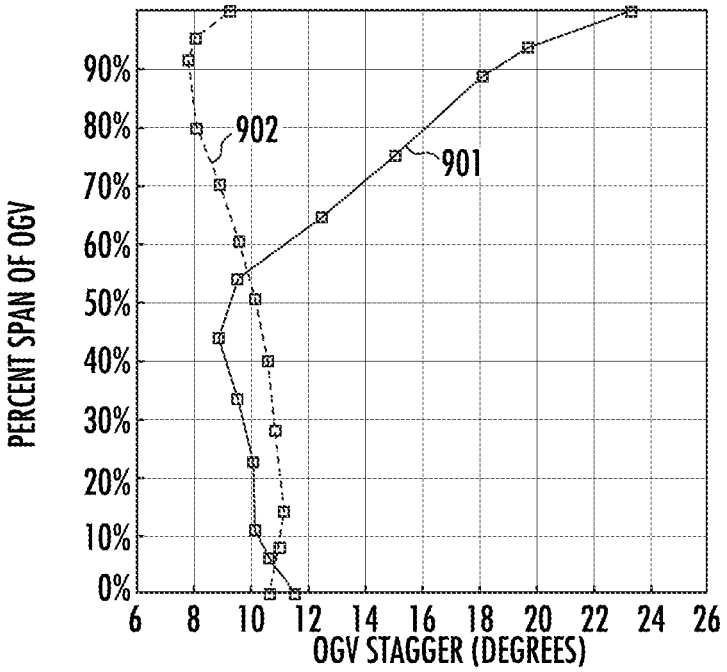
FIG. 9 is a chart depicting outlet guide vane stagger as a function of span.

Turning now to FIG. 6, a schematic view of the outlet guide vane assembly 51 of FIG. 5 is depicted as viewed along the longitudinal centerline 12. As shown, a reference radial position R1 is provided to characterize features of the outlet guide vanes 52. For example, each of the plurality of outlet guide vanes 52 can be configured to have identical, similar, or related properties to one another at a given radial position R1. An infinite number of reference radial positions may be provided to define a profile as shown in FIGS. 8 and 9. These reference radial positions may also be used to characterize average or overall properties along such profiles, where the identified quantity is not necessarily indicative of a plurality of identically-configured outlet guide vanes 52 at the reference radial position R1, but could represent an average value at that position. In such a manner, it will be appreciated that the term "profile" with respect to a parameter or characteristic of a stage of airfoils refers to an average value for such parameter or characteristic of each of the airfoils in the stage of airfoils along a span of each of the respective airfoils. For example, with respect to the outlet guide vanes 52, a "solidity profile" of the outlet guide vanes 52 may refer to an average solidity value for each outlet guide vane 52 of the plurality of outlet guide vanes 52 along the span 206 of the outlet guide vanes 52.

Although the embodiment shown has the outlet guide vane assembly 51 centered around the longitudinal centerline 12, it should be appreciated that the outlet guide vane assembly 51 may be offset from the longitudinal centerline 12 and may have at least one degree of asymmetry. In this case but also in fully symmetrical embodiments, corresponding ones of the plurality of outlet guide vanes 52 can be compared by a percent of the span 206 from a base 90 to a tip 92, where zero percent of the span 206 corresponds to the base 90 and/or the inner shroud 88 and where one hundred percent of the span 206 corresponds to the tip 92 and/or the outer shroud 86. In such a manner, it will be appreciated that the outlet guide vane assembly 51 defines an inner boundary along the radial direction R and an outer boundary along the radial direction R. For example, in certain embodiments, respective bases 90 and/or the inner shroud 88 can be used to define the inner boundary of the outlet guide vane assembly 51 and respective tips 92 and/or the outer shroud 86 can be used to define the outer boundary of the outlet guide vane assembly 51.

Although individual ones of the plurality of outlet guide vanes 52 may differ, group characteristics can still be defined by the use of a reference radial position R1 or by use of a percent of the span 206 as described above. For example, at a given radial position R1 or a given percent of the span 206, there may be at least two distinct chords 212 (see FIG. 5) defined by the plurality of outlet guide vanes 52. In this case, an average chord may be defined by determining a sum of the chords 212 of each of the plurality of outlet guide vanes 52 then dividing by a quantity or total number of the plurality of outlet guide vanes 52. Accordingly, in addition to the features and characteristics of individual ones of the outlet guide vanes 52, characteristics of a plurality of the outlet guide vanes 52 or of the outlet guide vane assembly 51 may be defined.

As another example, a spacing S1, S2 may be defined between adjacent outlet guide vanes 52. As shown in FIGS. 5 and 6, a first spacing S1 is provided between a first pair of adjacent outlet guide vanes 52 and a second spacing S2 is provided between a second pair of adjacent outlet guide vanes 52. It should be understood that the spacing S1, S2 may also be variable as measured along the span 206 of an outlet guide vane 52 in the radial direction R. For example, the spacing S1, S2 between adjacent outlet guide vanes 52 may increase while moving outward in the radial direction R if the outlet guide vanes 52 are uniform in chord 212 and stagger angle (described in more detail below with reference to FIG. 7). However, the outlet guide vanes 52 may be specifically configured to manage the spacing S1, S2 in conjunction with the other features of individual outlet guide vanes 52 and the outlet guide vane assembly 51.

Figure 7:
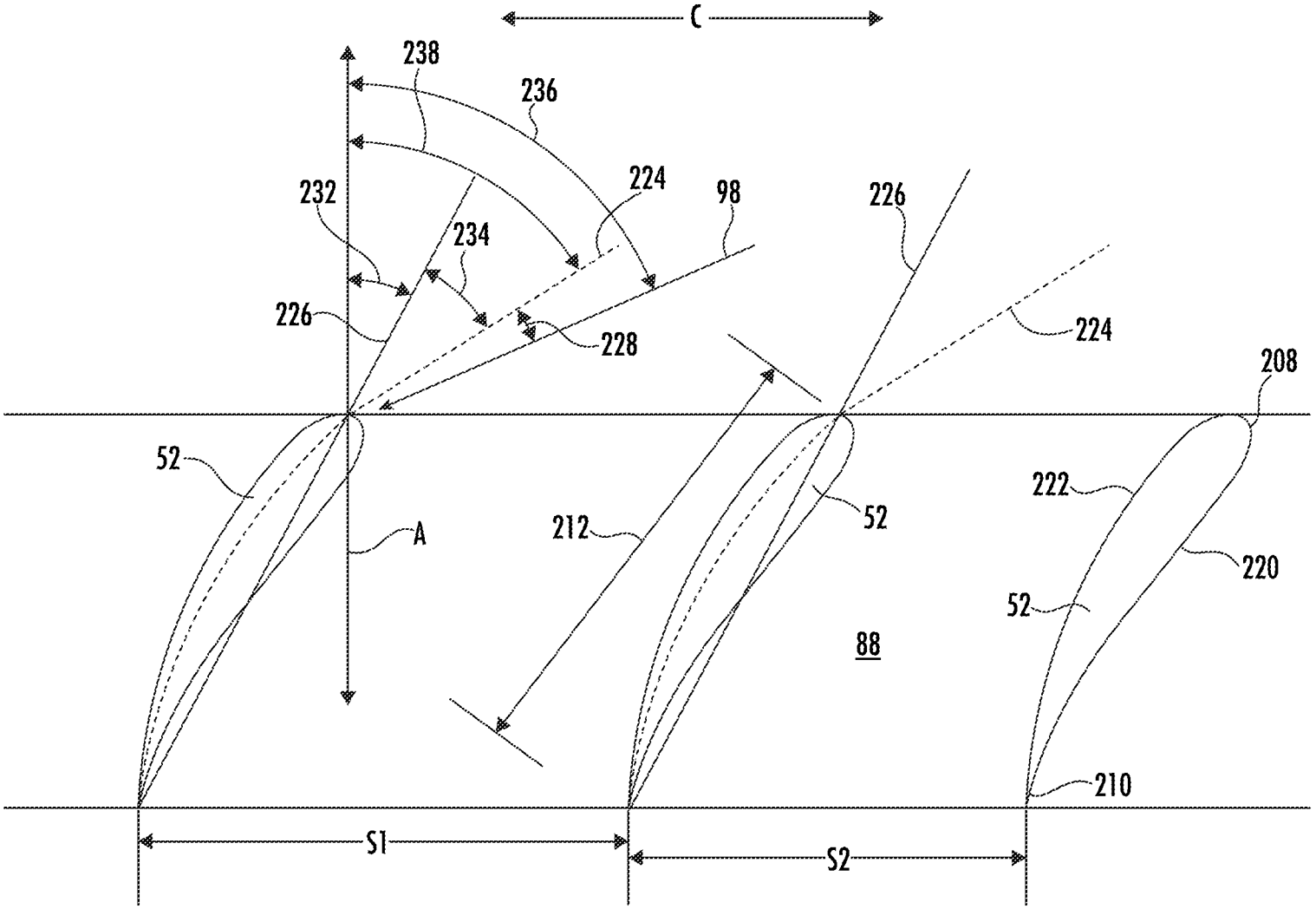
FIG. 7 is a partial schematic top view of the outlet guide vane assembly of FIG. 6 taken along line 7-7 in FIG. 6.

Referring now to FIG. 7, providing an overhead partial view of the guide vane assembly 51 in the schematic diagram of FIG. 6 taken along line 7-7, aerodynamic profiles of some of the plurality of outlet guide vanes 52 can be seen. As depicted, the cross-section of each outlet guide vane 52 is configured generally as an airfoil having a pressure side 220 and suction side 222 opposite the pressure side 220. This airfoil extends between the leading edge 208 and the trailing edge 210 of the outlet guide vane 52 along a camber line 224. The camber line 224 defines an angle of attack 228 with an airflow direction 98 of the airflow 58 past the fan 38 as indicated by arrow 62 in FIG. 1, also referred to as the bypass airflow. For the embodiment depicted, the angle of attack 228 at the location depicted along the span 206 (See FIG. 6) of the outlet guide vane 52 is tunable to achieve the desired properties as described in greater detail with reference to FIGS. 8 and 9. Additionally, the outlet guide vane 52 defines a chord line 226 extending directly from its leading edge 208 to its trailing edge 210. The chord line 226 defines the chord 212 of the outlet guide vane 52 from leading edge 208 to trailing edge 210.

As depicted, the airflow 58 reaching the outlet guide vanes 52 does not arrive at the leading edge 208 of the outlet guide vanes 52 in the axial direction A, but rather this airflow direction 98 is angled relative to the axial direction A at what is known as an air inlet angle 236. The air inlet angle 236 is indicative of a downstream thrust velocity component of the airflow 58 in combination with a circumferential velocity component imparted upstream by the inlet pre-swirl features 80 and the fan 38.

The outlet guide vanes 52 further define an inlet angle 238 describing the angular offset between respective camber lines 224 and the axial direction A extending from the leading edges 208. A positive angle of attack 228 is achieved when the air inlet angle 236 exceeds the inlet angle 238. One component of the inlet angle 238 is a camber angle 234 describing the angular offset between the respective camber lines 224 and chord lines 226 extending from the leading edges 208. The remaining component of the inlet angle 238 is defined as a stagger angle 232, or an angular offset between the respective chord lines 226 and the axial direction A extending from the leading edges 208. An exemplary profile chart of the stagger angle 232 is depicted in FIG. 9 as a function of span 206 of the outlet guide vanes 52.

Figure 13:
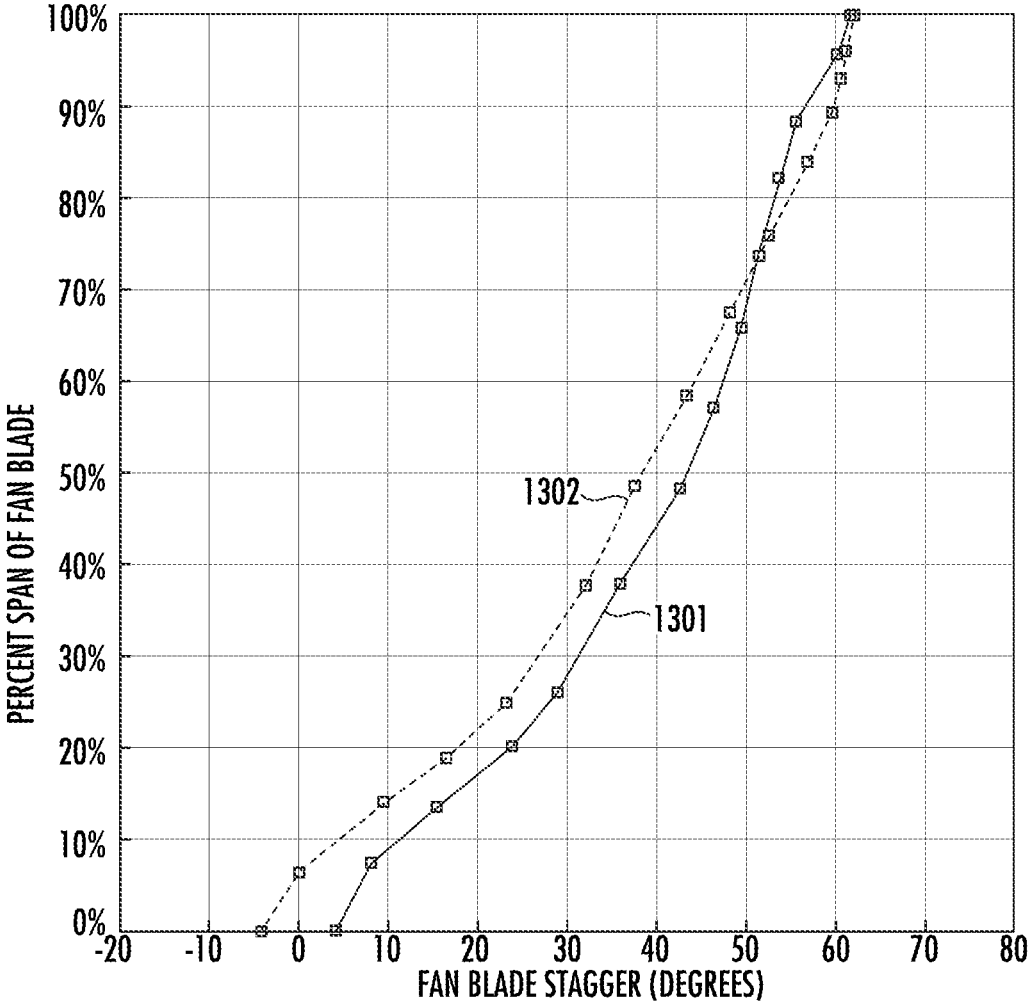
FIG. 13 is a chart depicting fan blade stagger as a function of span.

As described above, a stagger angle may be defined for any of the aerodynamic features described herein such as the fan blades 40, the inlet pre-swirl features 80, and the outlet guide vanes 52. The stagger angle is defined based on the chord line 126, 226 of a given feature, for example as shown in FIGS. 3, 4, and 7 in relation to the axial direction A. As depicted in FIGS. 9 and 13, the stagger angle is a tunable variable along the span of a given component to achieve desired properties. For example, a relatively low or even negative stagger angle can be applied to control a generally axial airflow 58 and a relatively large stagger angle can be employed to control airflow 58 with a relatively large circumferential component.

Referring still to FIG. 7, tuning of the various other angles and geometries can be employed to achieve other desired flow properties. For example, it has been found that the use of inlet pre-swirl features 80 upstream can facilitate tuning to increase the spacing S1, S2 between outlet guide vanes 52 and/or reduce the chord 212 of the outlet guide vanes 52. By adjusting these variables in this manner, a lower solidity can be achieved, as will be described in more detail below.

Referring now to FIG. 8, a chart depicts exemplary embodiments of a solidity profile for a stage of outlet guide vanes 52. A first solidity profile 801 represents the solidity profile of a first plurality of outlet guide vanes 52 of a first outlet guide vane assembly 51 (See FIG. 5). Solidity as described herein is a dimensionless quantity representative of a relationship of chord in proportion to spacing (i.e., calculated by dividing a chord of an outlet guide vane at a specific radial position by a spacing with an adjacent outlet guide vane at the same radial position). In the chart of FIG. 8, the first solidity profile 801 is determined at each position corresponding to a percent span 206 (See FIG. 5) of the outlet guide vanes 52 by dividing the average chord 212 (See FIG. 5) by the average spacing S1, S2 (See FIG. 5). In this manner, a solidity can be calculated for each position even for asymmetric embodiments of the outlet guide vanes 52. As described above, solidity can be increased by increasing the chord 212 or by decreasing the spacing S1, S2. Conversely, solidity can be reduced by reducing the chord 212 or by decreasing the spacing S1, S2.

Upstream influence on the volume of air 58 by the inlet pre-swirl features 80 is advantageously controlled by specific configuration of the first solidity profile 801 of the outlet guide vanes 52 as described herein. It should be appreciated that adjustments to upstream components like the pre-swirl features 80 (See FIG. 2) and the fan 38 (See FIG. 2) influence the advantageous embodiments of the first solidity profile 801 as described herein.

The exemplary first solidity profile 801 depicted has a minimum solidity proximate a radial position at fifty percent of the span 206 of the outlet guide vanes 52. As used herein, it should be understood that the term "proximate" refers to a radial position nearer fifty percent of the span 206 than to either of the extremes of the span 206 at zero percent or one hundred percent. For example, the first solidity profile 801 may achieve the minimum solidity at a radial position between an inner boundary, defined along the radial direction R by the inner shroud 88 (See FIG. 5) and/or the bases 90 (See FIG. 5) of the outlet guide vanes 52, and e.g., fifty, sixty, or seventy percent of the span 206 of the outlet guide vanes 52. For example, the first solidity profile 801 may achieve the minimum solidity nearer the inner boundary than an outer boundary in the radial direction R, for example at approximately forty five percent of the span 206 as shown in FIG. 8. The minimum solidity achieved may be relatively low, for example below a value of two. In various embodiments, the minimum solidity achieved may be between one and two, for example less than 1.98, less than 1.96, less than 1.8, less than 1.6, less than 1.5 or less than 1.4.

A maximum solidity is also defined by the first exemplary solidity profile 801. As shown in FIG. 8, a maximum solidity may be achieved proximate the inner boundary, as in nearer the inner boundary than the outer boundary. For example, the maximum solidity may be achieved at the base 90 of the outlet guide vanes 52, the inner shroud 88, or zero percent of the span 206 of the outlet guide vanes 52. The maximum solidity may still be achieved proximate, but not at, the inner boundary, for example between the inner boundary and five percent, ten percent, or fifteen percent of the span 206 of the outlet guide vanes 52. The maximum solidity provided here may be representative of a relatively large chord 212 of the outlet guide vanes proximate the base 90. This configuration advantageously provides mechanical strength for the outlet guide vanes 52 while maximizing flow benefits of reduced solidity further radially outward along the span 206 as described above. The maximum solidity achieved here may be relatively high, as in a range from 2.0 to 3.0 For example, the maximum solidity achieved in various embodiments may be greater than 2.1, greater than 2.2, or greater than 2.25.

In addition to maximum and minimum solidity, also referred to as absolute maximum and absolute minimum solidity, one or more local maximum and/or local minimum solidity values may be defined. A local minimum solidity is achieved at a radial position where the solidity is lower than both an adjacent radially outer point and an adjacent radially inner point. A local maximum solidity is achieved a radial position where the solidity is higher than both an adjacent radially outer point and an adjacent radially inner point.

Advantageously, a relatively low solidity can be maintained between a mechanically strong radially inner portion and a local maximum solidity proximate the outer boundary. For example, the first exemplary solidity profile 801 may remain below a solidity of 2.0 from between ten percent, twenty percent, or thirty percent to a local maximum proximate the outer boundary or to the outer boundary itself as depicted in FIG. 8.

As above, a local maximum solidity may be achieved proximate the outer boundary. For example, a local maximum solidity may be achieved at a radial position corresponding to about fifty percent, sixty percent, seventy percent, eighty percent, or ninety percent of the span 206. Alternatively, the local maximum solidity may be achieved at the outer boundary. The same or higher value as the local maximum solidity may then not be achieved again moving radially inward until a position proximate the inner boundary, for example at a position corresponding to thirty, twenty, or ten percent of the span 206. Alternatively, as shown in a second exemplary solidity profile 802, the local described above may represent the overall maximum solidity value.

The second exemplary solidity profile 802 depicts a second embodiment according to the present disclosure. In contrast with this first exemplary solidity profile 801, the second exemplary solidity profile 802 does not ever achieve a solidity value greater than two. Although the second exemplary solidity profile 802 may represent relatively advantageous flow characteristics, the first exemplary solidity profile 801 can provide a mechanically stronger base 90 for the outlet guide vanes 52 given similar construction materials and methods. The relatively strong configuration of the first exemplary solidity profile 801 can advantageously control high speed, pre-swirled flow while retaining sufficient strength in such an environment. However, the second exemplary solidity profile 802 may be employed with the use of high-strength materials to improve flow management, for example by further reducing drag.

In contrast with the first and second exemplary solidity profiles 801, 802, a third exemplary solidity profile 803 as depicted contrasts with embodiments of the present disclosure. As depicted, the third exemplary solidity profile 803 is not tuned to achieve a local maximum or minimum solidity beyond its absolute maximum and minimum solidities. In comparison with the first and second exemplary solidity profiles 801, 802, the third exemplary solidity profile 803 may result in increased drag or further flow inefficiencies in a high speed, pre-swirled airflow 58.

Turning now to FIG. 9, a chart depicts exemplary embodiments of a stagger profile of outlet guide vanes of an outlet guide vane assembly, such as of the outlet guide vanes 52 of the outlet guide vane assembly 51 of FIGS. 1 through 7. The outlet guide vane stagger profile shows stagger angle, for example the stagger angle 232 depicted in FIG. 7, in relation to a percent of the span 206 of the outlet guide vanes 52 in the radial direction R. A first exemplary outlet guide vane stagger profile 901 is depicted as achieving a minimum stagger proximate fifty percent of the span 206 and a maximum stagger proximate the outer boundary. In various embodiments, the minimum stagger may be achieved between a radial position corresponding to seventy percent, sixty percent, or fifty percent of the span 206 and the inner boundary. As depicted, the minimum stagger achieved for the exemplary embodiment represented by the first exemplary outlet guide vane stagger profile 901 is about nine degrees at about forty five percent of the span 206. The depicted maximum stagger for the exemplary embodiment represented by the first exemplary outlet guide vane stagger profile 901 is greater than twenty three degrees at one hundred percent of the span 206. A relatively high maximum stagger may be provided, for example between twelve and thirty degrees. In various embodiments, the maximum stagger may be greater than sixteen degrees, eighteen degrees, twenty degrees, or twenty two degrees. A relationship between minimum and maximum stagger may be provided to describe an amount of contouring of the outlet guide vanes 52, wherein the maximum stagger may be as much as two hundred percent greater than the minimum stagger. For example, the maximum stagger may be at least forty percent, fifty percent, or sixty percent greater than the minimum stagger.

In contrast with the first exemplary outlet guide vane stagger profile 901, a second exemplary stagger profile 902 depicts a configuration not according to the present disclosure. As shown, the second exemplary stagger profile 902 is relatively flat, remaining between about eight and eleven degrees. Additionally, the second exemplary stagger profile 902 achieves a minimum stagger angle proximate the outer boundary and achieves a maximum stagger angle proximate the inner boundary.

With the second exemplary stagger profile 902 as contrast, advantageous aspects of the first exemplary outlet guide vane stagger profile 901 in a high speed, pre-swirled airflow environment. For example, the relatively large stagger angles achieved proximate the outer boundary advantageously manage the pre-swirled airflow 58 having interacted with the radially outer inlet pre-swirl features 80.

Figure 10:
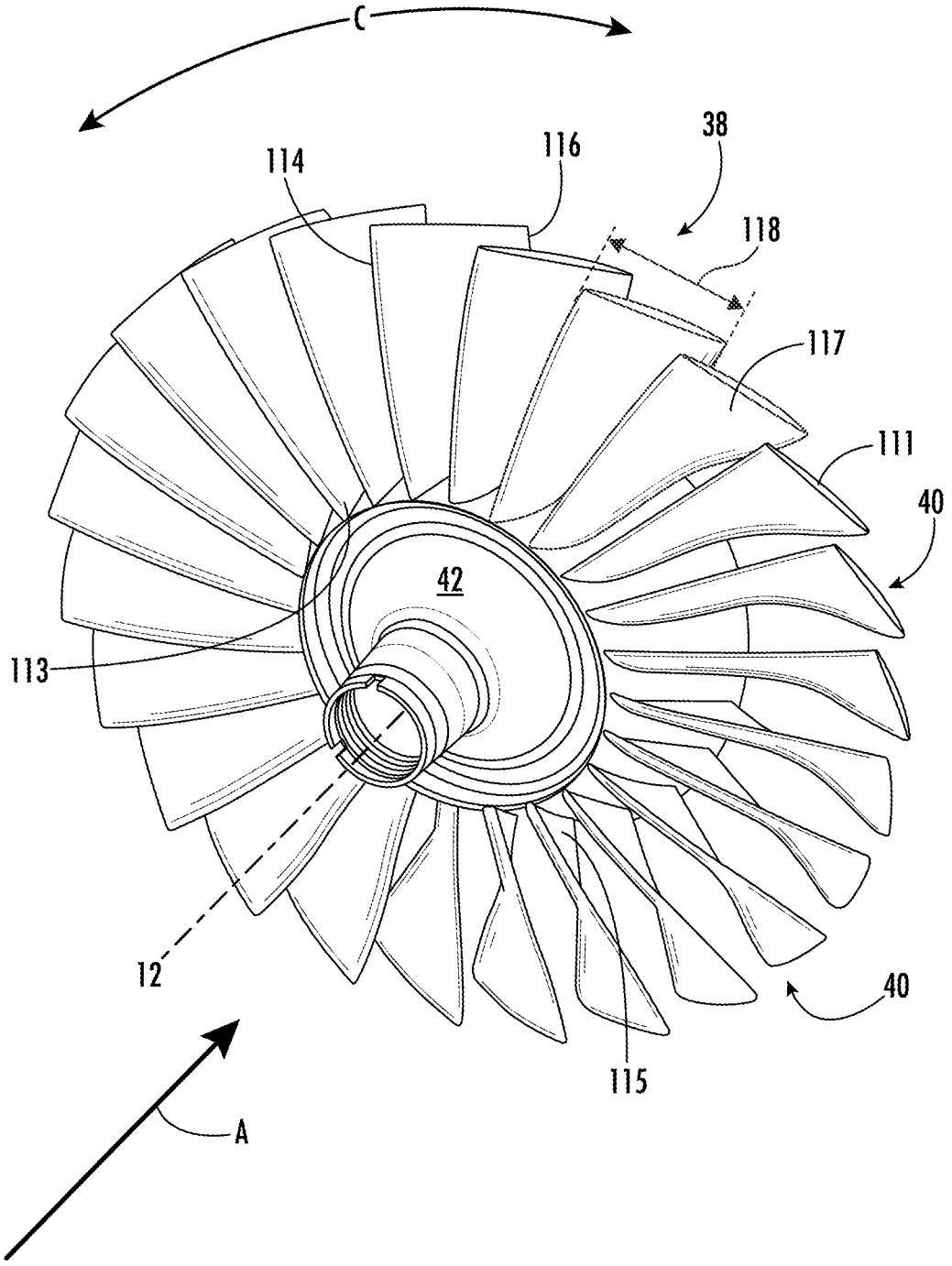
FIG. 10 is a perspective view of a fan assembly.

Turning now to FIG. 10, a perspective view of the fan 38 as depicted in FIG. 1 is shown in greater detail. Although not visible in FIG. 1, as will be appreciated from the view of FIG. 10, each of the fan blades 40 defines a pressure side 115 and a suction side 117. A chord 118 of the fan blades 40 is defined between the leading edge 114 and the trailing edge 116 along a chord line (not shown) as generally depicted in FIGS. 3, 4, and 7 with respect to outlet guide vanes 52. As in those exemplary embodiments, it should be understood that the fan blades 40 may be described as having the same aerodynamic features and characteristics as described above, including angle of attack, stagger angle, and camber angle.

As depicted in FIG. 10, a fan base 113 and a fan tip 111 define a radial extent of each of the plurality of fan blades 40. The fan base 113 defines a radial minimum or an inner boundary. The fan tip 111 defines a radial maximum or an outer boundary.

Figure 11:
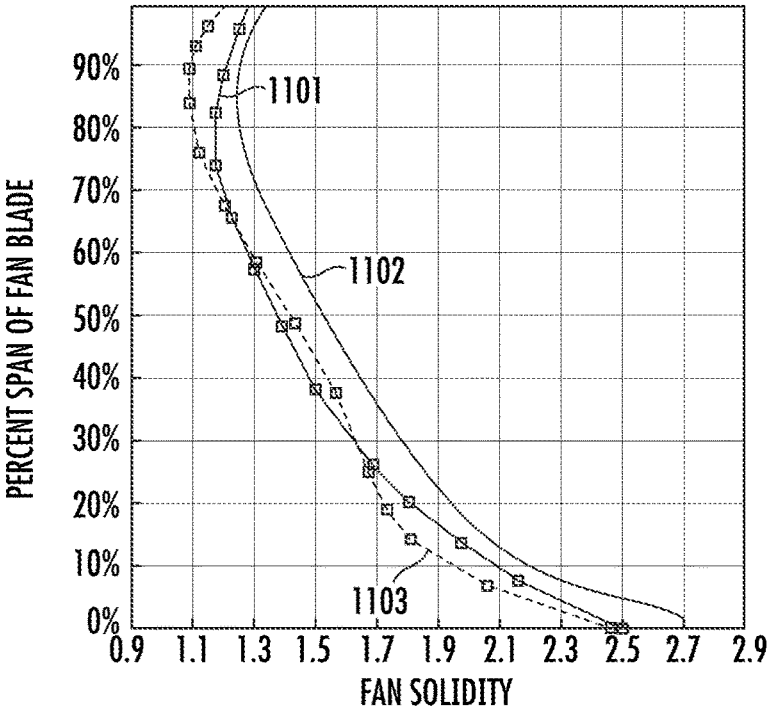
FIG. 11 is a chart depicting a fan solidity as a function of span.

Turning now to FIG. 11, a chart depicts exemplary embodiments of a solidity profile of the fan 38 of FIG. 10. As described above with reference to FIG. 8, solidity is defined as a dimensionless quantity of chord in proportion to spacing. A first exemplary fan solidity profile 1101 is provided according to an embodiment of the disclosure. As with the exemplary solidity profiles 801, 802, 803 of the outlet guide vanes 52 (See FIG. 8), the first exemplary fan solidity profile 1101 of the fan 38 is depicted between the inner boundary defined by the fan base 113 and the outer boundary defined by the fan tip 111 as shown in FIG. 10. In such a manner, it will be appreciated that the term "boundary" as it is used with the term outer boundary of the fan 38, does not refer to a physical boundary, but instead refers to a reference location defined by the fan tips 111 of the plurality of fan blades 40.

The first exemplary fan solidity profile 1101 is dependent on a quantity of the plurality of fan blades 40 and the chord 118 of the plurality of fan blades 40 at a given radial position relative to the longitudinal centerline 12. The first exemplary fan solidity profile 1101 as depicted in FIG. 11 is variable between the inner boundary and the outer boundary. In some embodiments, a fan solidity profile maintains a solidity of greater than 1.0, 1.1, or 1.2 between seventy percent, eighty percent, or ninety percent of a fan blade span 112 and the outer boundary. For example, a second exemplary fan solidity profile 1102 according to the present disclosure may maintain a solidity of between 1.3 and 1.4 between seventy percent, eighty percent, or ninety percent of the fan blade span 112 and the outer boundary.

In contrast with the first and second exemplary fan solidity profiles 1101, 1102, a third exemplary fan solidity profile 1103 depicts an embodiment not according to the present disclosure. As depicted, the third exemplary fan solidity profile 1103 differs from the first and second exemplary fan solidity profiles at least in having a relatively low solidity proximate the tips 111 of the fan blades 40. The exemplary embodiments according to the present disclosure and represented by the first and second exemplary fan solidity profiles 1101, 1102 advantageously employ a relatively high solidity in the radially outer region proximate the tips 111, for example to handle pre-swirled airflow 58 in a corresponding radially outer region of the inlet pre-swirl features 80.

Figure 12:
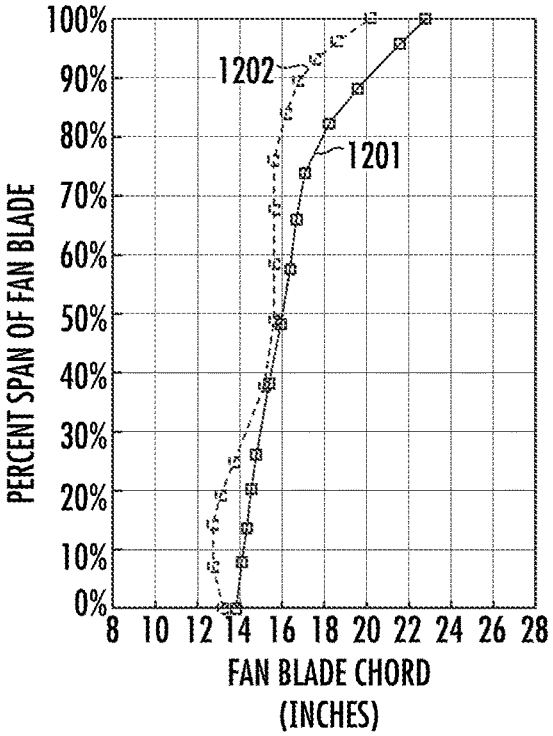
FIG. 12 is a chart depicting a fan blade chord as a function of span.

Referring now to FIG. 12, a chart depicts exemplary embodiments of FIG. 11 with relation to chord 118 of the fan blades 40 (See FIG. 10). As described above, while solidity may naturally increase moving radially outwards by an increase in spacing in the circumferential direction C, the chord 118 of the fan blades 40 can be adjusted or tuned to reduce or even reverse this reduction in solidity. A first exemplary chord profile 1201 as depicted corresponds to the first exemplary fan solidity profile 1101 in FIG. 11. The contrasting second exemplary chord profile 1202 corresponds to the third exemplary fan solidity profile 1103 in FIG. 11 representative of an embodiment not according to the present disclosure. As depicted, a relatively large increase in chord 118 proximate the tips 111 (See FIG. 10) results in the relatively high and increasing solidity depicted in the first exemplary fan solidity profile 1101 proximate the tips 111 in FIG. 11. As shown in FIG. 12, the first exemplary fan solidity profile 1101 achieves a chord 118 of greater than twenty two inches. In various embodiments, the maximum chord 118 achieved may be at least eighteen, nineteen, twenty, or twenty one inches.

The chord 118 may be related to a diameter of the fan 38 as described above. For example, the embodiments of the chord profile depicted in FIG. 12 may be defined in proportion to a fan 38 with an eighty, eighty four, eighty eight, or ninety two inch diameter. In various embodiments of the fan 38, the maximum chord 118 achieved may be greater than twenty percent, twenty one percent, twenty two percent, or twenty three percent of the diameter of the fan.

Turning now to FIG. 13, a chart depicts exemplary embodiments of a stagger angle distribution or stagger profile of the fan blades 40 or fan 38. As described above with reference to FIG. 9, the stagger profiles depicted define a stagger angle as described with reference to FIG. 7 along a span. Referring to FIG. 13, a first exemplary stagger profile 1301 defines a stagger angle of the fan blades 40 in relation to the span 112 of the fan blades 40. As depicted, the first exemplary stagger profile 1301 remains positive along the entire fan blade span 112. In contrast, a second exemplary stagger profile 1302 not according to the present disclosure depicts what may be a conventional high speed fan not employing inlet pre-swirl features 80. In this second exemplary stagger profile 1302, the stagger angle proximate the base 113 is relatively low and even negative in comparison with the relatively high stagger angle maintained to greater than fifty percent of the fan blade span 112 by the first exemplary stagger profile 1301.

Figure 14:
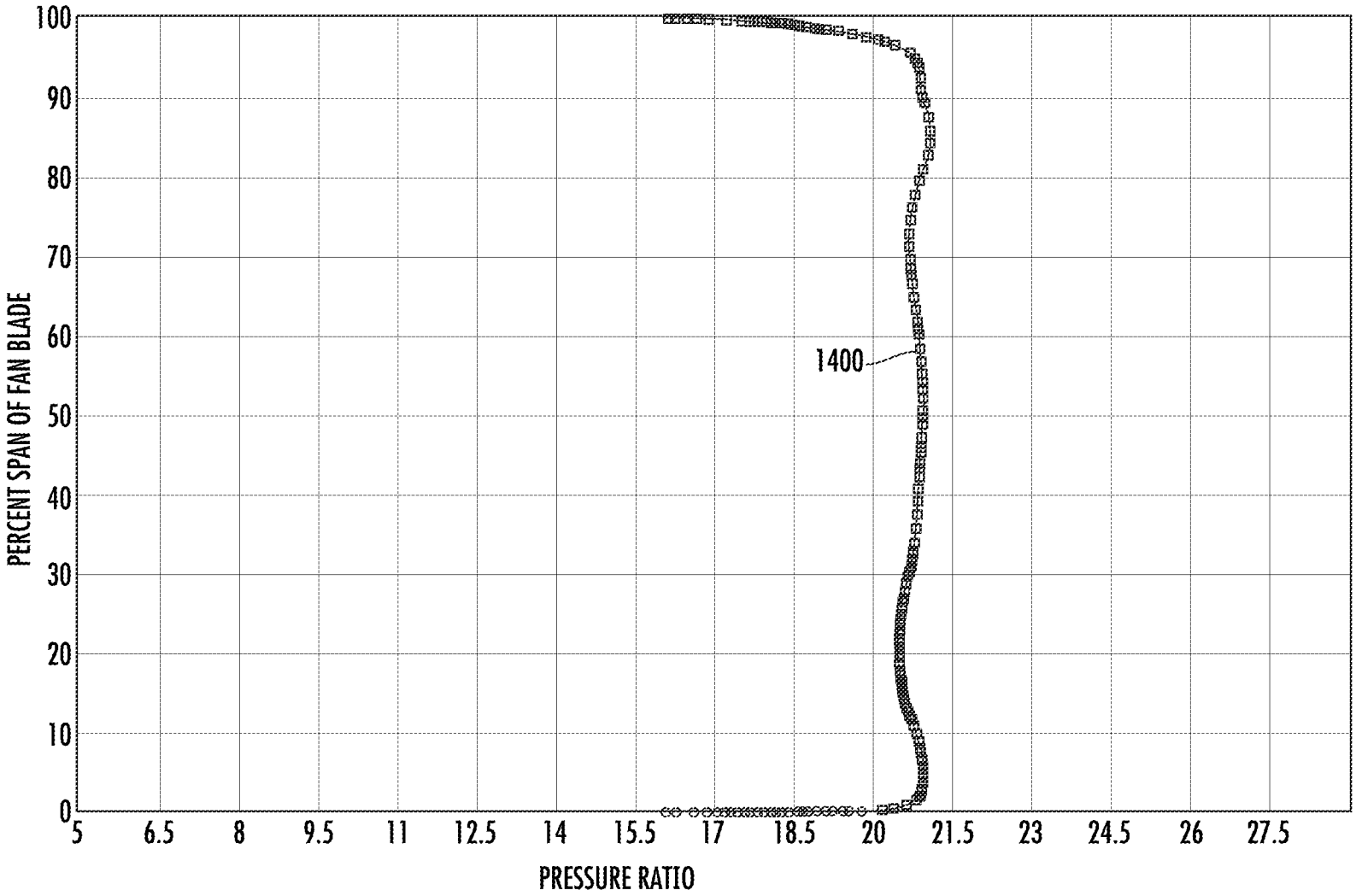
FIG. 14 is a chart depicting a pressure ratio profile of a fan as a function of span.

Referring to FIG. 14, a pressure ratio profile of an exemplary fan 38 (See FIG. 10) according to an embodiment of the disclosure is provided. A pressure ratio profile is defined as a profile of pressure ratios, as described above with reference to FIG. 1, along the span 112 of the fan blades 40 in the radial direction R. In contrast with other pressure ratio profiles, an exemplary pressure ratio profile 1400 depicted remains relatively flat across most positions in the radial direction R as defined by a percent of the span 112 of the fan blades 40. By employing a relatively flat pressure ratio profile 1400, a lower maximum pressure ratio may be employed than would otherwise be required. In various embodiments, the pressure ratio profile may not vary by more than five percent, ten percent, fifteen percent or twenty percent across a broad range defined by the span 112; for example between ten and ninety percent of the span 112 or between five and ninety five percent of the span 112.

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses:

A gas turbine engine comprising: a fan defining an axis of rotation and a radial direction; a plurality of inlet pre-swirl features disposed upstream of the fan; and an outlet guide vane assembly comprising a plurality of outlet guide vanes disposed downstream of the fan, the outlet guide vane assembly defining an inner boundary along the radial direction and an outer boundary along the radial direction, the outlet guide vane assembly comprising a plurality of outlet guide vanes defining: an outlet guide vane span extending from the inner boundary to the outer boundary; and an outlet guide vane solidity profile, wherein the outlet guide vane solidity profile is variable between the inner boundary and the outer boundary, and wherein the outlet guide vane solidity profile achieves a minimum solidity at a radial position between the inner boundary and seventy percent (70%) of the outlet guide vane span.

The gas turbine engine of any preceding clause, wherein the outlet guide vane solidity profile achieves the minimum solidity proximate the inner boundary.

The gas turbine engine of any preceding clause, wherein the outlet guide vane solidity profile achieves a maximum solidity proximate the inner boundary.

The gas turbine engine of any preceding clause, wherein the outlet guide vane solidity profile achieves the maximum solidity at a radial position between the inner boundary and ten percent (10%) of the outlet guide vane span.

The gas turbine engine of any preceding clause, wherein the maximum solidity is greater than 2.2.

The gas turbine engine of any preceding clause, wherein the outlet guide vane solidity profile remains below 2.0 from a radial position at twenty percent (20%) of the outlet guide vane span and the outer boundary.

The gas turbine engine of any preceding clause, wherein the outlet guide vane solidity profile achieves a local maximum solidity at a radial position between sixty percent (60%) of the outlet guide vane span and the outer boundary.

The gas turbine engine of any preceding clause, wherein the minimum solidity is less than 1.96.

The gas turbine engine of any preceding clause, wherein the plurality of outlet guide vanes defines an outlet guide vane stagger profile, the outlet guide vane stagger profile achieving a minimum stagger and a maximum stagger, wherein the maximum stagger is at least fifty percent (50%) greater than the minimum stagger.

The gas turbine engine of any preceding clause, wherein the minimum stagger is achieved at a radial position between the inner boundary and an inner sixty percent (60%) of the outlet guide vane span.

The gas turbine engine of any preceding clause, wherein the maximum stagger is at least twenty degrees (20°).

The gas turbine engine of any preceding clause, wherein the plurality of inlet pre-swirl features defines a swirl angle profile, wherein the swirl angle profile defines a minimum swirl angle proximate a radially inner end of the plurality of inlet pre-swirl features and a maximum swirl angle proximate a radially outer end of the plurality of inlet pre-swirl features.

The gas turbine engine of any preceding clause, wherein the minimum swirl angle is less than five degrees (5°) and the maximum swirl angle is greater than twelve degrees (12°).

The gas turbine engine of any preceding clause, wherein each of the plurality of inlet pre-swirl features is configured as a part span inlet guide vane attached to or integrated into a nacelle radially surrounding the fan.

A gas turbine engine comprising: a plurality of inlet pre-swirl features; and a fan disposed downstream of the plurality of inlet pre-swirl features and defining an axis of rotation and a radial direction, the fan defining an inner boundary along the radial direction and an outer boundary along the radial direction, the fan comprising a plurality of fan blades defining: a fan blade span extending from the inner boundary to the outer boundary in the radial direction; and a fan solidity profile, wherein the fan solidity profile is variable between the inner boundary and the outer boundary, and wherein the fan solidity profile maintains a solidity of greater than 1.1 between a radial position at seventy percent (70%) of the fan blade span and the outer boundary.

The gas turbine engine of any preceding clause, wherein the fan solidity profile maintains a solidity of between 1.3 and 1.4 between the radial position at seventy percent (70%) of the fan blade span and the outer boundary.

The gas turbine engine of any preceding clause, wherein each of the plurality of inlet pre-swirl features is configured as a part span inlet guide vane having a pre-swirl feature span of between radial positions at five percent (5%) and fifty five percent (55%) of the fan blade span.

The gas turbine engine of any preceding clause, wherein the plurality of inlet pre-swirl features defines a swirl angle profile, wherein the swirl angle profile defines a minimum swirl angle proximate an inner end of the plurality of inlet pre-swirl features along the radial direction and a maximum swirl angle proximate an outer end of the plurality of inlet pre-swirl features along the radial direction.

The gas turbine engine of any preceding clause, wherein each fan blade of the plurality of fan blades defines a tip portion, wherein each respective tip portion achieves a chord greater than twenty one percent (21%) of a diameter of the fan.

The gas turbine engine of any preceding clause, wherein a pressure ratio profile of the fan varies by no more than fifteen percent (15%) between a radial position at ten percent (10%) of the fan blade span and ninety percent (90%) of the fan blade span.

We claim:

1. A gas turbine engine comprising:

a fan defining an axis of rotation and a radial direction;

a plurality of inlet pre-swirl features disposed upstream of the fan; and an outlet guide vane assembly disposed downstream of the fan, the outlet guide vane assembly defining an inner boundary along the radial direction and an outer boundary along the radial direction, the outlet guide vane assembly comprising a plurality of outlet guide vanes defining:

an outlet guide vane span extending from the inner boundary to the outer boundary; and an outlet guide vane solidity profile, wherein the outlet guide vane solidity profile is variable between the inner boundary and the outer boundary, and wherein the outlet guide vane solidity profile achieves a minimum solidity at a radial position between the inner boundary and seventy percent (70%) of the outlet guide vane span.

2. The gas turbine engine of claim 1, wherein the outlet guide vane solidity profile achieves the minimum solidity proximate the inner boundary.

3. The gas turbine engine of claim 1, wherein the outlet guide vane solidity profile achieves a maximum solidity proximate the inner boundary.

4. The gas turbine engine of claim 3, wherein the outlet guide vane solidity profile achieves the maximum solidity at a radial position between the inner boundary and ten percent (10%) of the outlet guide vane span.

5. The gas turbine engine of claim 4, wherein the maximum solidity is greater than 2.2.

6. The gas turbine engine of claim 5, wherein the outlet guide vane solidity profile remains below 2.0 from a radial position at twenty percent (20%) of the outlet guide vane span and the outer boundary.

7. The gas turbine engine of claim 4, wherein the outlet guide vane solidity profile achieves a local maximum solidity at a radial position between sixty percent (60%) of the outlet guide vane span and the outer boundary.

8. The gas turbine engine of claim 1, wherein the minimum solidity is less than 1.96.

9. The gas turbine engine of claim 1, wherein the plurality of outlet guide vanes defines an outlet guide vane stagger profile, the outlet guide vane stagger profile achieving a minimum stagger and a maximum stagger, wherein the maximum stagger is at least fifty percent (50%) greater than the minimum stagger.

10. The gas turbine engine of claim 9, wherein the minimum stagger is achieved at a radial position between the inner boundary and an inner sixty percent (60%) of the outlet guide vane span.

11. The gas turbine engine of claim 9, wherein the maximum stagger is at least twenty degrees (20°).

12. The gas turbine engine of claim 1, wherein the plurality of inlet pre-swirl features defines a swirl angle profile, wherein the swirl angle profile defines a minimum swirl angle proximate a radially inner end of the plurality of inlet pre-swirl features and a maximum swirl angle proximate a radially outer end of the plurality of inlet pre-swirl features.

13. The gas turbine engine of claim 12, wherein the minimum swirl angle is less than five degrees (5°) and the maximum swirl angle is greater than twelve degrees (12°).

14. The gas turbine engine of claim 1, wherein each of the plurality of inlet pre-swirl features is configured as a part span inlet guide vane attached to or integrated into a nacelle radially surrounding the fan.

15. A gas turbine engine comprising:

a plurality of inlet pre-swirl features; and a fan disposed downstream of the plurality of inlet pre-swirl features and defining an axis of rotation and a radial direction, the fan defining an inner boundary along the radial direction and an outer boundary along the radial direction, the fan comprising a plurality of fan blades defining:

a fan blade span extending from the inner boundary to the outer boundary in the radial direction; and a fan solidity profile, wherein the fan solidity profile is variable between the inner boundary and the outer boundary, and wherein the fan solidity profile maintains a solidity of greater than 1.1 between a radial position at seventy percent (70%) of the fan blade span and the outer boundary.

16. The gas turbine engine of claim 15, wherein the fan solidity profile maintains a solidity of between 1.3 and 1.4 between the radial position at seventy percent (70%) of the fan blade span and the outer boundary.

17. The gas turbine engine of claim 15, wherein each of the plurality of inlet pre-swirl features is configured as a part span inlet guide vane having a pre-swirl feature span of between radial positions at five percent (5%) and fifty five percent (55%) of the fan blade span.

18. The gas turbine engine of claim 17, wherein the plurality of inlet pre-swirl features defines a swirl angle profile, wherein the swirl angle profile defines a minimum swirl angle proximate an inner end of the plurality of inlet pre-swirl features along the radial direction and a maximum swirl angle proximate an outer end of the plurality of inlet pre-swirl features along the radial direction.

19. The gas turbine engine of claim 15, wherein each fan blade of the plurality of fan blades defines a tip portion, wherein each respective tip portion achieves a chord greater than twenty one percent (21%) of a diameter of the fan.

20. The gas turbine engine of claim 15, wherein a pressure ratio profile of the fan varies by no more than fifteen percent (15%) between a radial position at ten percent (10%) of the fan blade span and ninety percent (90%) of the fan blade span.

* * * * *